United States Patent [19]

Dallmann

[11] Patent Number: 5,040,267

[45] Date of Patent: Aug. 20, 1991

[54] CASEMENT HINGE

[75] Inventor: Brian D. Dallmann, Owatonna, Minn.

[73] Assignee: Truth Incorporated, Owatonna, Minn.

[21] Appl. No.: 531,935

[22] Filed: Jun. 1, 1990

[51] Int. Cl.[5] ..... E05D 11/08

[52] U.S. Cl. ..... 16/239; 16/235; 16/360; 16/361; 16/368; 16/370; 49/252

[58] Field of Search ..... 16/239, 240, 241, 337–339, 16/363, 364, 366, 368, 369, 357, 360, 361, 370, 235; 292/263; 49/248–251, 260, 388

[56] References Cited

U.S. PATENT DOCUMENTS

| | | | |
|---|---|---|---|
| 2,932,848 | 4/1960 | Ahlgren | 16/338 |
| 3,156,955 | 11/1964 | Lindstedt | 49/251 |

FOREIGN PATENT DOCUMENTS

| | | | |
|---|---|---|---|
| 165521 | 10/1955 | Australia | 49/251 |
| 0001487 | 4/1979 | European Pat. Off. . | |
| 1133211 | 11/1968 | United Kingdom | 49/251 |
| 1323786 | 7/1973 | United Kingdom . | |
| 2150210 | 6/1985 | United Kingdom | 292/263 |
| 2214230 | 8/1989 | United Kingdom . | |

*Primary Examiner*—Richard K. Seidel
*Assistant Examiner*—Edward A. Brown
*Attorney, Agent, or Firm*—Wood, Phillips, Mason, Recktenwald & Van Santen

[57] ABSTRACT

A casement hinge is provided having a track mounted to a window frame, a sash arm mounted to a window sash and connected to a track pivot at one end, and a support arm pivotally connected to the sash arm at one end and having a track pivot at the other end. A block with a serrated surface defines one of the track pivots, and a rack secured to the track includes cooperating serrated surfaces for fixing the block to a selected position on the track. The rack and the block include cooperating surfaces allowing sag correction by wedging a tool between the cooperating surfaces. A tab and slot interconnection for centering the block relative to the rack during installation is provided where the tab is breakable from the member to which it is fixed when correcting sag. The track is formed with a longitudinal section mounted to the window frame, the longitudinal section having a guide portion on which a shoe slides and a mounting portion spaced from the window frame so as to be offset from the guide portion. The track further includes an upright section along one side of the longitudinal section and extending away from the window frame, an overhanging section supported on the upright section spaced from the longitudinal section, and a flange extending upright from the longitudinal section. The shoe defines the other of the track pivots and includes a guide member which slides along and between the longitudinal, upright, and overhanging sections and the track flange. The sash arm overlies the overhanging section when the window is closed.

37 Claims, 2 Drawing Sheets

FIG. 1
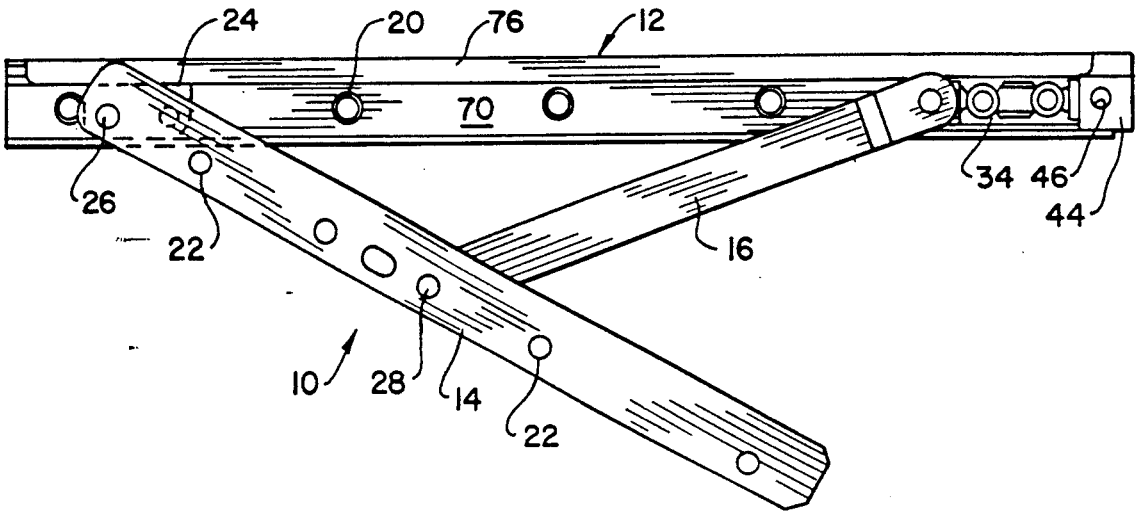
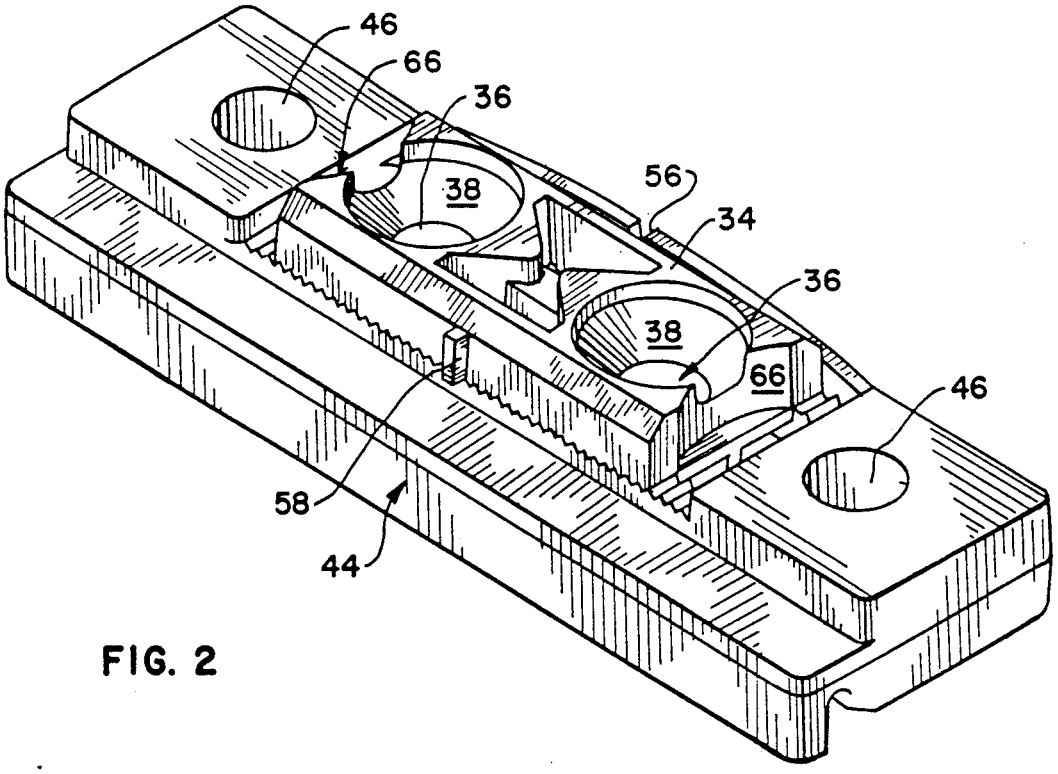
FIG. 2

CASEMENT HINGE

BACKGROUND OF THE INVENTION

1. Technical Field

The present invention is directed toward casement hinges for windows, and more particularly toward improved track pivots of casement hinges.

2. Background Art

The casement window has a window sash movably mounted within a frame by a pair of hinges mounted between the window frame and the top and bottom of the window sash. It is typical of such a hinge to have a track mountable to the window frame and a sash arm connectable to the window sash. A support arm interconnects the track and the sash arm, with the support arm being pivotally connected to the track and the sash arm. The sash arm is pivotally connected either directly or by means of an interconnecting link to a mounting shoe which is movably guided for movement lengthwise of the track. A window hinge of this type is shown, for example, in Tacheny et al. U.S. Pat. No. 4,726,092.

Another type of casement window hinge differs from the just-described window hinge in having the sash arm pivotally connected to the track by an intervening link, with the intervening link being pivotally fixed to the track, rather than to a movable shoe, and with a support arm pivotally connected to the sash arm also being pivotally mounted to a shoe movably guided on the track for movement lengthwise of the track. A window hinge of this type is shown, for example, in Vetter U.S. Pat. No. 4,674,149.

When window hinges of the above type are installed, proper operation and sealing of the window when closed requires that the fixed track pivot (on the window frame) be properly located relative to the window sash. Further, over the life of the window, the proper location of the fixed track pivot may change due to slight shifting of the window, window frame, etc., resulting in a sag in the sash. Sash sag is a condition formed when the sash and the frame of a window are no longer square to one another (in the closed position), or the edge of the sash which is opposite the hinges seems to sag in comparison to the frame of the window. As a result, the window may not seal tightly or open and close easily.

Heretofore, precise installation of the hinge and later correction of sash sag has required that the hinge track be provided with slotted holes and that the hinge mounting screws in the slotted holes be removed to allow for shifting of the track. Repeated removal of such screws can, however, over the life of a window result in a gradual loosening of the strength of the mounting. Further, the slotted holes, by providing only a frictional contact with the screw heads to prevent longitudinal shifting of the track, can allow the track to undesirably shift and/or loosen over the window life as a result of forces incurred from the wind, operating hardware, window weight, and even from forcing to gain improper entry through the window.

Of course, with either type of hinge as described above, it is also necessary to provide a slidable shoe which can operate smoothly and still be strong enough to withstand the substantial loads mentioned above.

The present invention is intended to avoid one or more of the problems discussed above.

SUMMARY OF THE INVENTION

In one aspect of the present invention, a casement hinge is provided having a track mounted to a window frame, a sash arm mounted to a window sash and connected to a track pivot at one end, and a support arm pivotally connected to the sash arm at one end and having a track pivot at the other end. A block member defines one of the track pivots and includes a serrated surface, and a rack member is secured to the track and including cooperating serrated surface for fixing said block member at a selected position on the track.

Other aspects of this invention include cooperating surfaces are on the rack member and the block member allowing sag correction by wedging a tool between the cooperating surfaces, and a tab and slot interconnection for centering the block member relative to the rack member during installation with the tab being breakable from the member to which it is fixed when correcting sag.

In another aspect of the present invention, the track is formed with a longitudinal section mounted to the window frame, an upright section along one side of the longitudinal section and extending away from the window frame, and an overhanging section supported on the upright section spaced from the longitudinal section. The track further includes a flange extending upright from the longitudinal section. A shoe defining the other of the track pivots includes a guide member which slides along and between the longitudinal, upright, and overhanging sections and the track flange. Further, the shoe may include a metal stiffener extending into its guide member.

Other aspects of this invention include orientation of the sash arm adjacent the overhanging section when the window is closed, and the provision of a longitudinal section having a guide portion on which the shoe slides and a mounting portion spaced from the window frame so as to be offset from the guide portion.

It is an object of the invention to provide a casement hinge which may be easily and precisely installed.

It is another object of the present invention to provide a casement hinge which can sustain substantial loading to remain securely mounted and minimize any loosening of the hinge over the life of the window.

It is still another object of the present invention to provide a casement hinge which may be easily adjusted over the life of the window to ensure that a tight seal be provided when the window is closed and that the window be easily and smoothly operated at all times.

BRIEF DESCRIPTION OF THE DRAWINGS

FIG. 1 is a plan view of one type of casement hinge embodying the present invention;

FIG. 2 is a perspective view of the rack-block assembly of the present invention following adjustment;

DESCRIPTION OF THE PREFERRED EMBODIMENT

Figure 3:
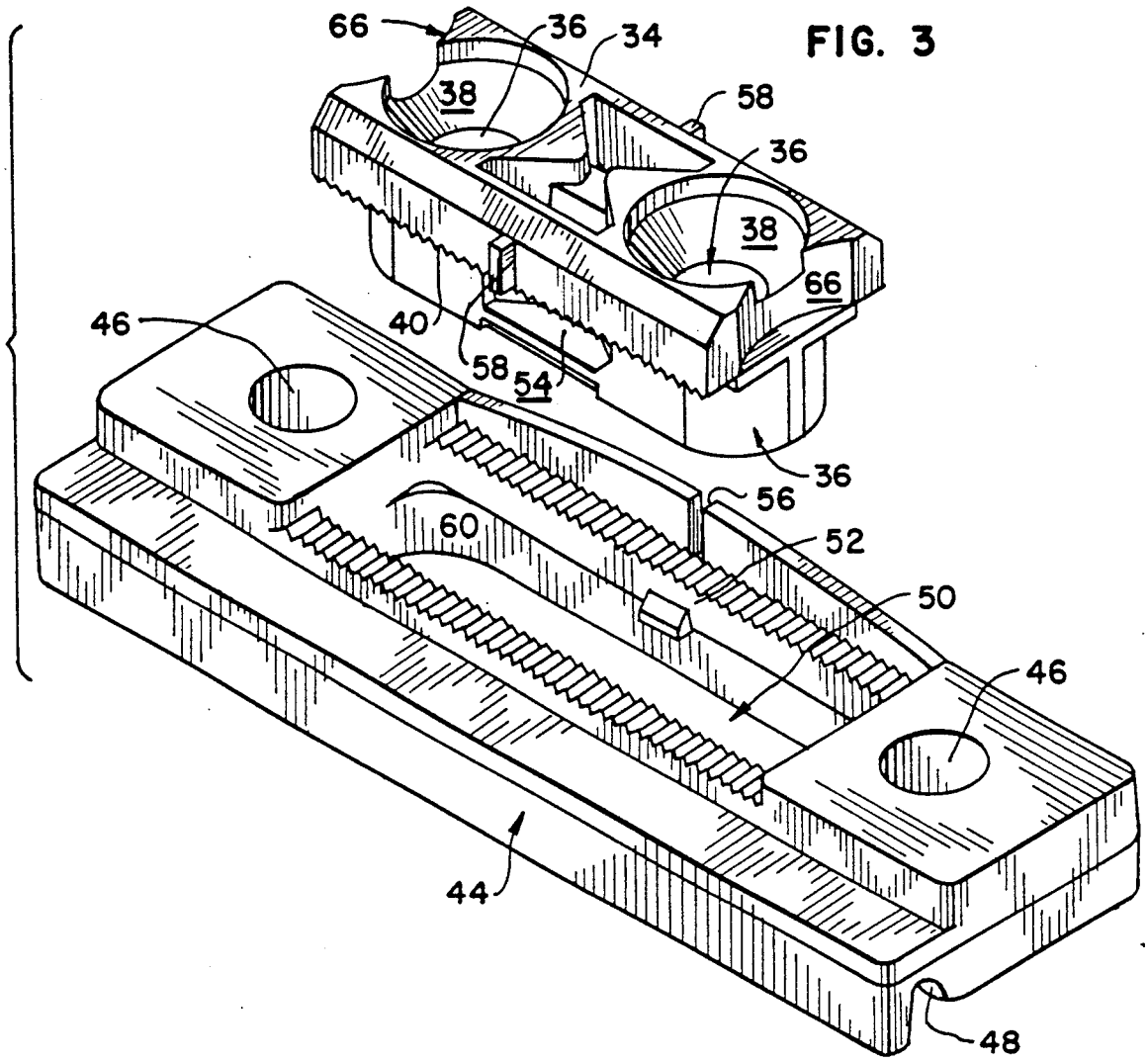
FIG. 3 is a perspective exploded view of the rack and block of the present invention.

A casement hinge 10 embodying the present invention is shown in FIG. 1. The hinge 10 includes a track 12, a sash arm 14, and a support arm 16.

The track 12 includes a number of openings 20 therethrough through which suitable screws (not shown) may be inserted for mounting the track 12 to a window frame. Other aspects of the track 12 are also described below in connection with the present invention.

The sash arm 14 includes a number of openings 22 therethrough through which suitable screws (not shown) may be inserted for mounting the sash arm 14 along the side of a window sash (not shown) such that the hinge 10 connects the window sash to the window frame for suitable opening and closing of the window. The sash arm 14 is connected to a shoe 24 on one end by a suitable rivet 26 or the like for pivotal connection therebetween, and at an intermediate location is pivotally connected to one end of the support arm 16 by another suitable rivet 28. The shoe 24, which is described in greater detail further below, is slidable longitudinally along the track 12.

The other end of the support arm 16 is pivotally connected to a point selectively fixed on the track 12 in a manner described in greater detail hereafter.

It will be understood by a person of ordinary skill in this art that the description given above is one type of conventional arrangement for a window casement hinge. Further, once an understanding of the present invention is gained by such persons, it will also be recognized that the invention described hereafter may also be suitably used with other types of hinges (including, for example, hinges in which the sash arm has a fixed pivot relative to the track and the support arm is pivoted to a movable shoe).

FIGS. 2 and 3 show the structure for providing the fixed pivot at the end of the support arm 16. Specifically, a rack 34 is provided having two bosses 36 with countersunk openings 38 to allow for securing the rack 34 to the window frame by insertion of suitable screws (not shown) through the bosses 36 and openings in the track 12, whereby the rack 34 may by tightened toward the track 12 by the engagement of suitable screw heads with the countersunk openings 38. Inasmuch as the present invention does not require shifting of the track 12 as will hereafter become apparent, these track openings may be circular to securely mount the track 12 against any longitudinal movement.

The rack 34 also includes longitudinally aligned serrated surfaces 40 along both sides (the edge of one can be seen in FIGS. 2 and 3), which surfaces 40 face toward the track 12 when installed.

Mounted between the rack 34 and the track 12 is a block 44. The block 44 includes suitable rivet openings 46 for defining the fixed pivot at the end of the support arm 16. Two such openings 46 are provided on opposite ends of the block 44 to allow blocks to be used in various different installations (since, as will become apparent, it is important that the support arm 16 be installed so as to not overlie the rack 34). The block 44 also includes a slot 48 for proper mounting in the track 12 for reasons which will become apparent hereafter in the discussion of the shoe 24.

The block 44 also includes a central longitudinal opening 50 which is slightly longer than the rack 34 for a reason which will become apparent. The rack bosses 38 are received in this block opening 50 and the two are maintained together by a suitable snap fit, such as by engagement of block side tabs 52 and rack flanges 54 (opposite ones of which can be seen in FIG. 3).

Further, to ensure proper centering of the rack 34 and block 44 relative to one another during initial installation (to ensure that adjustments may be made thereafter in either direction as described below), a slot 56 is provided on the block 44 for receiving tabs 58 on the rack 34. Tabs 58 are provided on both sides of the rack 34 in order to ensure this alignment inasmuch as the rack 34 can be properly snap fit into the block 44 with either side adjacent the slot 56. Further, inasmuch as the rack is preferably made of plastic, the tab 58 in the slot 56 may be snapped off during adjustment of the block 44 as hereafter described without interfering with such adjustment.

The block 44 further has serrated surfaces 60 along both sides, which surfaces 60 engage the rack serrated surfaces 40 when the assembly is installed.

This assembly thus works as follows. The rack 34 is securely mounted to the track 12 and window sash by suitable screws as previously described. Further, the block is squeezed between the rack 34 and the track 12, so that the block 44 is similarly securely held in place by the interengagement of the rack and block serrated surfaces 40, 60.

When the fixed pivot defined by the block rivet opening 46 must be moved longitudinally along the track 12 to correct for sash sag (whether during initial installation or developing over time), the mounting screws for the rack 34 are loosened, but not removed. A suitable hand tool is then wedged between the end of the central block opening 50 and the rack curved surface 66 on the end toward which the pivot is to be shifted. For example, where the hand tool is a screwdriver, the blade end of the screwdriver may be simply turned between those surfaces to force the rack 34 and the block 44 apart at that point. Inasmuch as the rack 34 is fixed relative to the track 12 and window frame, forcing the two apart effectively moves the block 44 in that direction relative to the track 12, and thus similarly moves the block pivot opening 46 as desired to correct for sash sag. FIG. 2 shows the rack 34 and block 44 after such an adjustment moving the pivot (and block 44) to the right (note that the rack tab on the side adjacent the block slot 56 has been broken off and is thus no longer there). Once the desired adjustment has been made, the screws are tightened to once again fixedly secure the block 44 beneath the rack 34.

As will be apparent to a person of ordinary skill in this art once an understanding of the present invention is obtained, precise incremental adjustment of the block 44 can be provided by providing selected size serrations (such as 1/16 of an inch).

It is thus apparent that the rack and block assembly of the present invention can be easily and precisely installed. Further, this assembly will withstand substantial loading while remaining securely mounted with virtually no undesired shifting of the fixed pivot over the life of the window. Still further, this assembly may be easily adjusted over the life of the window to correct for sash sag which might develop from shifting of other window and hinge components to ensure that a tight seal be provided when the window is closed and that the window be easily and smoothly operated at all times.

Figure 4:
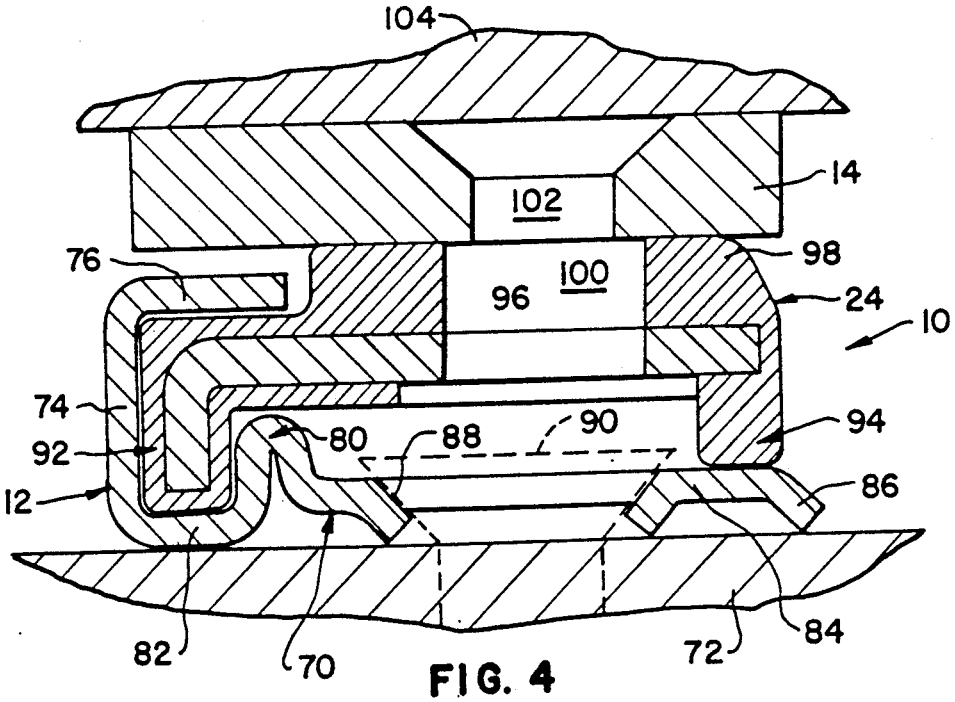
FIG. 4 is a cross-sectional view of the track and shoe of the present invention taken through the sash arm pivot and showing the window in the closed position.

Such advantages are further enhanced by the cooperating structure of the track 12 and shoe 24. Specifically, in a preferred embodiment of the present invention as shown in FIG. 4, the track 12 is formed with a longitudinal section 70 mounted to the window frame 72. The track 12 also includes an upright edge section 74 supporting a over-hanging section 76 which is substantially parallel to the longitudinal section 70 to thereby define a longitudinal path for sliding of the shoe 24.

The track 12 further includes a longitudinal flange 80 suitably formed in the longitudinal section 70, as by crimping the section 70 along its length. Further, the longitudinal flange 80 separates the section 70 into a longitudinal guide portion 82 and a longitudinal mounting portion 84. The guide portion 82 bears against the window frame 72. The mounting portion 84 is spaced from the window frame 72 not only by the configuration of the flange 80, but also by a bent edge 86 and by the countersunk holes 88 stamped for the track mounting screws (one such screw 90 being shown in phantom in FIG. 4).

The shoe 24 is preferrably formed of a suitable hard, tough plastic material with two longitudinally extending legs 92, 94, one of which 92 rides on the track guide portion 82 between the upright edge section 74 and the flange 80. In addition, a stiffener 96 formed of sheet metal or the like is preferrably molded to span the shoe 24 and extend into the guide leg 92.

The shoe 24 includes a raised portion 98 on which the sash arm 14 is supported. The shoe 24 and stiffener 96 further include a rivet opening 100 through which the shoe rivet 26 (not shown in FIG. 4) extends to define the pivot for the sash arm 14. As will be understood by those skilled in this art, the shoe rivet 26 should include a reduced diameter portion extending through the sash arm 14 (as indicated by the sash arm opening 102 in FIG. 4) so that the sash arm 14 will bear on a rivet shoulder to avoid binding of the arm 14 on the shoe 24.

The above described track 12 and shoe 24 configuration provides easy and smooth sliding of the shoe 24 during opening and closing of the window, and at the same time provides a strong connection of the shoe 24 to the track 12 to prevent the shoe 24 from being dislodged from the track 12 as a result of the various wind, weight and other forces on the window sash.

Specifically, the elevation of the mounting portion 84 of the track 12 above the guide portion 82 causes the encountered forces (generally to the right in FIG. 4) to be withstood by lateral shear stresses in the track 12 and screw 90 (whereas conventional tracks have heretofore tended to rely on the lesser bending strength of the components at the connection of the track 12 and screw 90).

Still further, as can be seen in FIG. 4, when the window is closed, the hinge 10 is confined in a space between the window frame 72 and the window sash 104, which space cannot be expanded without breaking the frame 72 or sash 104. As a result of the hinge configuration, if someone tries to force the window open (to the right in FIG. 4), dislodging the shoe 24 would require that the guide leg 92 clear the track flange 80. However, dislodging the shoe 24 cannot be accomplished in this confined space inasmuch as the shoe 24 would have to bend the track overhanging section 76 (up in FIG. 4), and the sash arm 14 (which is fixed against the rigid window sash 104) prevents that section 76 from bending enough for the guide leg 92 to clear the flange 80.

It has been found that, as a result of the above factors, this hinge 10 can provide an increase of up to about 50% over prior conventional hinges in the force which can be withstood without dislodging the shoe 24 or otherwise damaging the track 12.

Still other aspects, objects, and advantages of the present invention can be obtained from a study of the specification, the drawings, and the appended claims.

I claim:

1. In a casement hinge having a track for mounting to a window frame, a sash arm for mounting to a window sash and connected to a track pivot at one end, and a support arm pivotally connected to the sash arm at one end and having a track pivot at the other end, one of said track pivots being fixed relative to the track and the other of said pivots being slidable relative to the track, the improvement comprising:

a block member defining the fixed one of the track pivots; and a rack member fixedly secured to said track and including means for fixing said block member at a selected position on said track to correct for sag in said hinge.

2. The improvement of claim 1, wherein said block member is mounted between said rack member and said track and said means for fixing comprises mating serrated surfaces.

3. The improvement of claim 1, further comprising a first surface on the rack member and a second surface on said block member allowing sag correction by wedging a tool between said surfaces to shift the block member relative to the rack member.

4. The improvement of claim 3, wherein sets of first and second surfaces are provided at opposite ends of the rack member to allow for sag correction in opposite directions.

5. The improvement of claim 1, further comprising a tab and slot interconnection for centering said block member relative to said rack member during installation, said tab being breakable from the member to which it is fixed when correcting sag.

6. The improvement of claim 1, wherein said block member and rack member are maintained together by a snap fit connection.

7. The improvement of claim 1, wherein the block member defines the track pivot at one end of the sash arm.

8. The improvement of claim 1, wherein the other track pivot comprises a pivotal connection with a shoe slidable along said track.

9. The improvement of claim 8, wherein the block member defines the track pivot at one end of the sash arm and the shoe defines the track pivot at the other end of the support arm.

10. The improvement of claim 8, wherein the track comprises a longitudinal section mounted to the window frame, an upright section along one side of the longitudinal section and extending away from the window frame, an overhanging section supported on the upright section spaced from the longitudinal section, and a flange extending upright from the longitudinal section; and the shoe includes a body portion defining the other pivotal connection and a guide member adapted to slide longitudinally between said longitudinal, upright, and overhanging sections and said track flange.

11. The improvement of claim 10, wherein said overhanging section overhangs said track flange.

12. The improvement of claim 10, wherein said track flange is formed by a longitudinal crimp in the longitudinal section.

13. The improvement of claim 10, wherein said track flange is substantially perpendicular to the longitudinal section.

14. The improvement of claim 10, wherein the block member defines the track pivot at one end of the sash arm and the shoe defines the track pivot at the other end of the support arm.

15. The improvement of claim 10, wherein the longitudinal section includes a guide portion on which the shoe slides and a mounting portion, said guide portion being against the window frame and said mounting portion being parallel to and spaced from the window frame.

16. The improvement of claim 10, wherein the shoe defines the track pivot at one end of the sash arm and the sash arm overlies the overhanging section when the window is closed.

17. In a casement hinge having a track for mounting to a window frame, a sash arm for mounting to a window sash and connected to a track pivot at one end, and a support arm pivotally connected to the sash arm at one end and having a track pivot at the other end, wherein the track includes a longitudinal section mounted to the window frame, an upright section along one side of the longitudinal section and extending away from the window frame, and an overhanging section supported on the upright section spaced from the longitudinal section, the improvement comprising:

a track flange extending upright from the longitudinal section; and a shoe having a body portion defining one of the track pivots and a guide member adapted to slide longitudinally between said longitudinal, upright, and overhanging sections and said track flange;

wherein the sash arm overlies the overhanging section when the window is closed.

18. The improvement of claim 17, wherein said overhanging section overhangs said track flange.

19. The improvement of claim 17, wherein said track flange is formed by a longitudinal crimp in the longitudinal section.

20. The improvement of claim 17, wherein said track flange is substantially perpendicular to the longitudinal section.

21. The improvement of claim 17, wherein the shoe defines the track pivot at the other end of the support arm.

22. The improvement of claim 17, wherein the longitudinal section includes a guide portion on which the shoe slides and a mounting portion, said guide portion being against the window frame and said mounting portion being parallel to and spaced from the window frame.

23. The improvement of claim 17, wherein the shoe defines the track pivot at one end of the sash arm.

24. The improvement of claim 23, wherein the longitudinal section includes a guide portion on which the shoe slides and a mounting portion, said guide portion being against the window frame and said mounting portion being parallel to and spaced from the window frame.

25. The improvement of claim 23, wherein the shoe includes a metal stiffener extending into its guide member.

26. The improvement of claim 17, wherein the shoe includes a metal stiffener extending into its guide member.

27. In a casement hinge having a track for mounting to a window frame, a sash arm for mounting to a window sash and connected to a track pivot at one end, and a support arm pivotally connected to the sash arm at one end and having a track pivot at the other end, wherein the track includes a longitudinal section mounted to the window frame, an upright section along one side of the longitudinal section and extending away from the window frame, and an overhanging section supported on the upright section spaced from the longitudinal section, the improvement comprising:

a block member defining one of the track pivots;

a rack member fixedly secured to said track and including means for fixing said block member at a selected position on said track to correct for sag in said hinge;

a track flange extending upright from the longitudinal section; and a shoe having a body portion defining the other of the track pivots and a guide member adapted to slide longitudinally between said longitudinal, upright, and overhanging sections and said track flange.

28. The improvement of claim 27, wherein said block member is mounted between said rack member and said rack member and said fixing means comprises mating serrated surfaces.

29. The improvement of claim 27, further comprising a first surface on the rack member and a second surface on said block member allowing sag correction by wedging a tool between said surfaces to shift the block member relative to the rack member.

30. The improvement of claim 27, further comprising a tab and slot interconnection for centering said block member relative to said rack member during installation, said tab being breakable from the member to which it is fixed when correcting sag.

31. The improvement of claim 27, wherein the block member defines the track pivot at one end of the sash arm and the shoe defines the track pivot at the other end of the support arm.

32. The improvement of claim 27, wherein said track flange is formed by a longitudinal crimp in the longitudinal section.

33. The improvement of claim 27, wherein the longitudinal section includes a guide portion on which the shoe slides and a mounting portion, said mounting portion being offset from the guide portion by spacing from the window frame.

34. The improvement of claim 27, wherein the shoe defines the track pivot at one end of the sash arm and the sash arm overlies the overhanging section when the window is closed.

35. The improvement of claim 34, wherein the longitudinal section includes a guide portion on which the shoe slides and a mounting portion, said mounting portion being offset from the guide portion by spacing from the window frame.

36. The improvement of claim 34, wherein the shoe includes a metal stiffener extending into its guide member.

37. The improvement of claim 27, wherein the shoe includes a metal stiffener extending into its guide member.

* * * * *